US005318437A

United States Patent [19]

Perez

[11] Patent Number: 5,318,437

[45] Date of Patent: Jun. 7, 1994

[54] AUTOMATIC SYSTEM TO FEED BURNERS WITH DIESEL OR LIGHT FUEL-OIL

[75] Inventor: Antonio S. Perez, Madrid, Spain

[73] Assignee: Investigacion Y Produccion, S.A., Madrid, Spain

[21] Appl. No.: 968,438

[22] Filed: Oct. 29, 1992

[51] Int. Cl.[5] ..... F23N 5/24

[52] U.S. Cl. ..... 431/16; 431/22; 431/65; 431/117

[58] Field of Search ..... 431/2, 16, 22, 65, 117, 431/118, 12; 137/563

[56] References Cited

U.S. PATENT DOCUMENTS 3,232,332 2/1966 Schuss et al. ..... 431/22
4,490,105 12/1984 Hunsberger et al. ..... 431/65
4,788,963 12/1988 Mutchler ..... 431/117

FOREIGN PATENT DOCUMENTS 160125 5/1983 Fed. Rep. of Germany ..... 431/117

*Primary Examiner*—James C. Yeung
*Attorney, Agent, or Firm*—Fish & Richardson

[57] ABSTRACT

From a fuel storage tank (13), a filter (1) is installed to prevent any obstruction, followed by a vacuum gauge (2) and a motor-driven pump (3) to deliver the fuel to the burner (12): immediately prior to said burner, there is a pressure relief valve (11). Said vacuum gauge (2) controls the suction of the motor-driven pump (3) and the level of dirt in the filter (1). A retention valve (4) is installed following said motor-driven pump (3), with a pressure gauge (5) and a pressurestat (6) fitted with two contacts, one for maximum and minimum or service contact, and the other for safety, to prevent fuel spillage in case of a pipe breakage, shutting off the motor-driven pump (3) to which the pressurestat (6) is connected by an electrical control (7). A safety valve opens if pressure is excessive and returns the fuel to the storage tank (13) while an expansion tank (8) keeps continuous pressure in the circuits even though the motor-driven pump (3) is operating intermittently. Any excess fuel is eliminated from the burner (12) by a return system fitted with a retention valve (16), through the pipe (14) situated upstream from the relief valve (11).

7 Claims, 1 Drawing Sheet

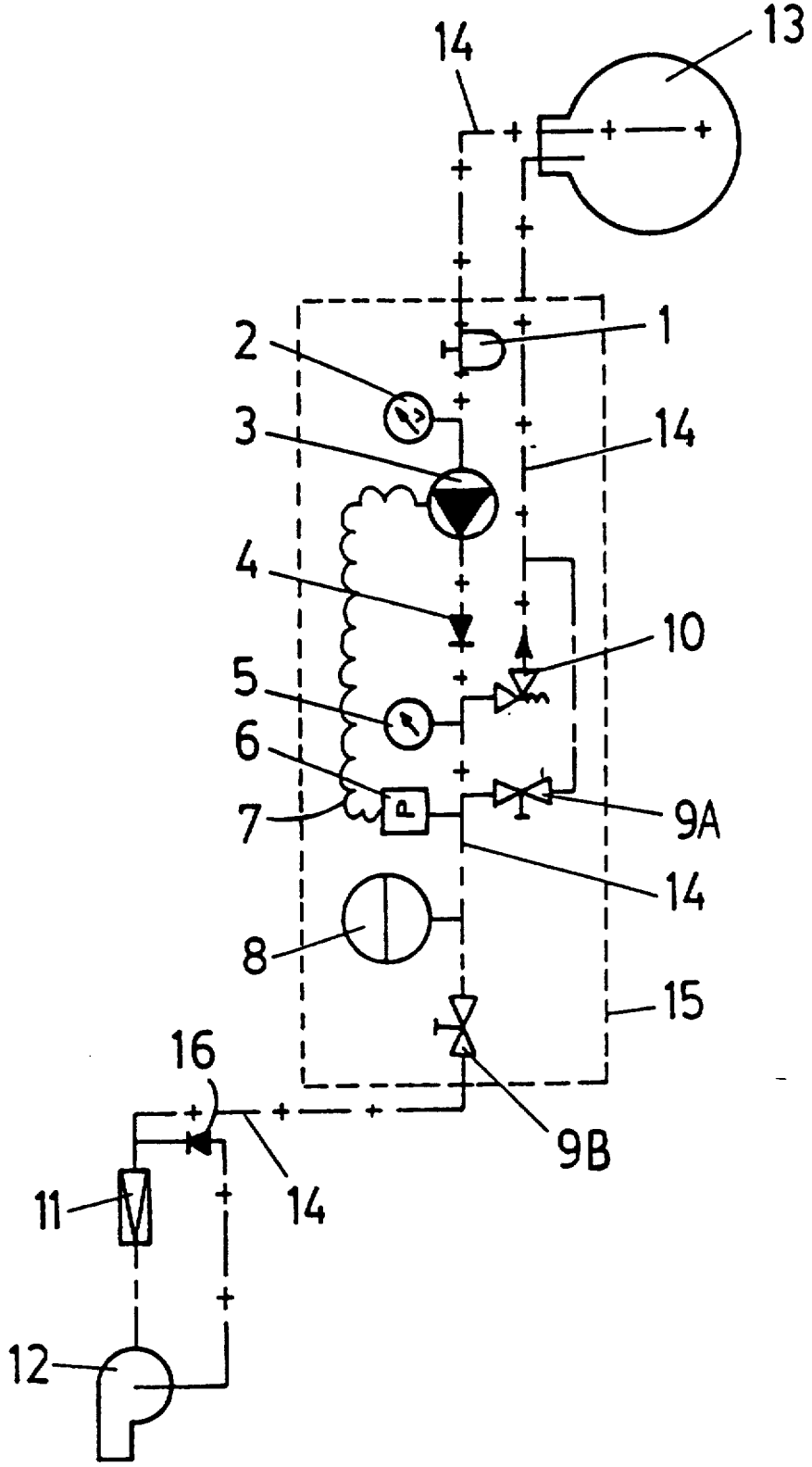
13
14
1
2
3
14
4
10
5
6
7
9A
14
8
15
16
9B
11
14
12

AUTOMATIC SYSTEM TO FEED BURNERS WITH DIESEL OR LIGHT FUEL-OIL

SUBJECT OF THE INVENTION

This invention refers to a new system permitting automatic feed to burners with diesel or light fuel-oil, intended to obtain optimal performance with maximum structural simplicity.

BACKGROUND TO THE INVENTION

In most heat-production installations using a liquid fuel of the type referred to above, three essential parts can be defined: a ventilated storage tank with a filling port and level control, a pressure unit with all the automatic components, safety devices and filters and suction and delivery piping, usually not more than 15 mm in diameter as only the fuel used by the burner is delivered, soft copper piping being the most commonly used to avoid welds and sleeves and, finally, the associated burner.

A pressure relief valve is fitted alongside the burner, incorporating a pressure gauge to indicate the output pressure so that each burner manufacturer can adjust the value to provide the optimum pressure for each type of burner and so avoid damage to its components. On the other hand, suction problems with the pump incorporated into each burner are avoided.

If the burner includes return, this is delivered through the pipe between the pressure relief valve and the pressure unit: the relief valve limits excess pressure in the burner both while operating and while stopped.

The nozzle circuit, loop circuit and direct burner suction systems are familiar burner feed systems.

The nozzle circuit is considered to be the most effective of these, as it facilitates burner suction, removes air pockets, and suction pressure is minimal. On the other hand, it is very expensive to install.

Pressure in the loop circuit cannot be controlled and an electric pump is required, to operate non-stop. Pipe diameters are usually 42 mm. A return is required to the tank and it is not possible to eliminate air pockets. If pipes break, the fuel in the general tank may spill, with risk of fire or water contamination.

SUMMARY OF THE INVENTION

The automatic system for burner feed put forward in this invention is intended to provide a completely satisfactory solution to the problem set out above, increasing the possibilities with an undefined number of burners. In this sense, in comparison with the classical nozzle circuit, using the system in the invention, installation is possible in a single eight-hour day, the pipe diameter can be reduced to just 15 mm, the electrical installation requires only a wall plug alongside the equipment and, for units of up to 300 l/h, the motor can be single-phase. Masonrywork is much reduced, on the one hand due to the use of piping with a much smaller diameter and, on the other, because the equipment just requires some nails in the wall from which to suspend it. Material stockpiling is reduced to a few meters of piping, the equipment itself, the relief valve and the piping connection accessory.

Burner suction is facilitated because the pressure is constant at the suction intake. Air pockets remain in the pressure tank and are eventually dispersed in the fuel because it is under continuous pressure. The burner receives the fuel at a pressure which, as already explained, is regulated by the manufacturer itself according to its own criteria, something which is not possible using the nozzle system. The flow for each unit is from zero to the maximum indicated: it is to be remembered that the maximum flow is well below the flow of the pump incorporated into each unit, so that a burner consuming 65 l/h will operate with a 2K 65 unit without forcing it.

Unlike the loop circuit, the automatic system in the invention incorporates two additional safety elements: the first is a valve in case the pressurestat fails and the pressure rises, causing the pump to recirculate, while the second is a contact that shuts the whole system down if the circuit pressure drops below a pre-set level as would occur if there is any breakage in the equipment input.

To do this, more specifically, it is a feature of the invention that the system is based on a filter located at the tank outlet to prevent any obstruction in the equipment components or in the piping or the burner, a vacuum gauge controlling the motor-pump suction and dirt in the filter, a motor-driven geared pump with single or three phase drive, an expansion tank which maintains constant pressure in the circuits and the intermittent running of the motor-driven pump, a two-contact pressurestat (one service contact, with maximum and minimum, and a safety contact to prevent fuel spillage if the piping breaks) which stops the motor and operates the associated warning light, an impulsion pressure control gauge, and a safety valve which opens if pressure is excessive, returning the fuel to the storage tank.

Another feature of the invention is that there are elastic elements to dampen vibrations from the motor-driven pump, and to prevent such vibrations from being transmitted to the base plate and so to the walls where it is installed. In parallel, a flexible pipe system also prevents these vibrations from reaching the installation as a whole, so avoiding breakage caused by fatigue.

In addition, all the elements of the group are fitted on a plate which can be wall-mounted, connected by a collector with a stop valve for impulsion, a drain device and a special retention valve to maintain pressure while the equipment is stopped.

A further feature of the invention is the provision of the pressure unit to be fitted with a standby system, in which case there are two motors, pumps, pressurestats, motor protection units, and retention valves: the two motors are electrically independent while the pumps operate alternately as long as there is no fault in either of them, in which case the other comes into permanent operation until the problem is fixed.

BRIEF DESCRIPTION OF THE DRAWING

To complete this description and to aid in a better grasp of the characteristics of the invention, these Specifications are accompanied by a single page of drawings, forming an integral part hereof: the FIGURE contains a diagrammatic representation, given by way of illustration and without limitation, of an automatic system for feeding a burner with diesel or light fuel-oil designed according to this invention.

DESCRIPTION OF A PREFERRED EMBODIMENT

The FIGURE shows how the automatic system to feed burners put forward here is structured in a line from the tank to the burner, with a filter (1), preferably of the basket or self-cleaning type, to prevent obstructions in the elements of the equipment and in piping and burner. Following said filter (1) a vacuum gauge (2) controls the suction by the motor-driven pump (3) and the amount of dirt in the equipment (1). Said pump (3) is preferably a geared type, with a single-phase motor up to a flow of 300 1/h: over that FIGURE, the motor must be three-phase.

A pressure gauge (5) controls the impulse pressure while a pressurestat (6) has two contacts, a service contact with maximum and minimum, and a safety contact to prevent fuel spillage should the pipes break, shutting the motor off and operating a control light indicating the fault. For these purposes, the pressurestat (6) is linked to the motor-driven pump (3) with the associated electrical control (7).

An expansion tank (8) maintains the continuous pressure in the circuits and the intermittent operation of the motor-driven pump (3).

A safety valve (10) is installed following the pump and retention valve (4): it opens if pressure is excessive, and it returns the fuel to the storage tank (13). Said safety valve (10) is bridged with a gate valve (9A).

Following the expansion tank (8), a further gate valve (9B) is installed in the piping to the burner (12) which is immediately preceded by a pressure relief valve (11).

The pipes linking the above elements are referenced number 14 in the FIGURE: for preference, this piping is of a special flexible pressure type for use with hydrocarbons.

All these elements are fitted on a steel plate or sheet (15) designed to be wall-mounted.

Any excess fuel is removed from the burner (12) with a return system fitted with a retention valve (16) running to the pipes (14) located upstream from the pressure relief valve 11.

Optionally, the system can incorporate a two-pump pressure group (3) in which case the following elements must be duplicated: the motor, pump, pressurestat, motor protection and retention valve. The motors are electrically independent.

One pump maintains normal service while the second remains on standby: however, for preference, the two pumps should alternate, to prevent seizing in the standby unit due to its lack of use.

In more specific terms, the groups have an electronic control to start the motor pumps alternately so that, as already mentioned, neither pump is off for long periods of time, so that it will not seize. Equipment with electronic control has one pressurestat. That with alternate controls has a single pressurestat which varies the working and safety pressure field. The whole operation is carried out at 127 or 220 V and 50/60 Hz.

This alternative control ensures that, if one pump fails, the other runs the cycle normally, operated through an optical warning light advising of the fault.

To overcome the problem of limited space close to the tank or of excess environmental dust or humidity which would be damaging to the most sensitive parts of the equipment, the elements can be arranged to form the system on two separate plates, one alongside the storage tank (13) and the other in the boiler room or buildings: the first plate incorporates the filter, vacuum gauge, pump, waterproofed motor, retention valve, excess pressure safety valve and the system bleeding system, and the second the pressurestat, pressure gauge, motor protection, expansion bowl and, if necessary, the alternating electronic control. The two plates are connected by an impulsion pipe and the electrical wire for the motor: the impulsion pipe to the burners is distributed from the second plate, if there is more than one burner.

What is claimed is:

1. An automatic system to feed burners with diesel or light fuel-oil, comprising an automatic pressure system of equipment elements, connected in sequence by a system of piping extending from an upstream fuel storage tank to a downstream burner, comprising a filter to prevent any obstruction either in equipment elements or in piping and burners, a vacuum gauge to control the suction of a geared motor-driven pump and the level of dirt in the filter, the geared motor-driven pump with a single phase motor for feed of up to 300 1/h and three-phase for up to 1500 1/h, and an expansion tank to maintain continuous circuit pressure and intermittent operation of the motor-driven pump, a pressurestat with two contacts mounted in the piping system between said pressure gauge and said expansion tank, a first, service contact with maximum and minimum and a second, safety contact to prevent spillage of fuel in case of a pipe breakage and to shut the motor down and activate an associated warning lamp, a pressure gauge mounted in the piping system between said pump and said pressurestat to control impulsion pressure, a safety valve mounted in a segment of piping connecting between the fuel storage tank and the system of piping in a region upstream of the pressure gauge, which operates if pressure is excessive, delivering fuel to the fuel storage tank, and an electrical circuit and motor guard with associated protection and operational elements.

2. An automatic system to feed burners with diesel or light fuel-oil as set forth in claim 1, wherein said equipment elements are mounted on a plate adapted to be slung from a wall, connected by a collector with a stop valve for impulsion, a bleeding device and a special retention valve to maintain pressure while stopped.

3. An automatic system to feed burners with diesel or light fuel-oil as set forth in claim 1, wherein said automatic pressure system further comprises a standby motor assembly and the motor, pump, motor protection and retention valve are duplicated, the two motors being electrically independent, while one pump is kept in normal service and the other on standby, with the pressurestat set to a safety pressure which is less than the working pressure.

4. An automatic system to feed burners with diesel or light fuel-oil as set forth in claim 3, wherein said automatic pressure system comprises an electronic control to alternately activate the respective motor-driven pumps with each impulse.

5. An automatic system to feed burners with diesel or light fuel-oil as set forth in claim 1 wherein, as necessary to the requirements of the installation, selected equipment elements of said automatic pressure system are mounted on independent plates, said independent plates being installed separately, connected by an impulsion pipe and electrical wire for the motor; a delivery pipe to the burners being distributed from the second such plate.

6. An automatic system to feed burners with diesel or light fuel-oil as set forth in claim 5, wherein the following equipment elements are fitted on a first of said independent plates, mounted nearer the fuel storage tank: the filter, the vacuum gauge, the pump, the motor, the retention valve, the safety valve against excess pressure, and a system for bleeding the piping system; and the following equipment elements are fitted on a second of said independent plates, mounted further from the fuel storage tank: the pressurestat, the pressure gauge, the motor protection, the expansion tank and alternative electronic control device.

7. An automatic system to feed burners with diesel or light fuel-oil as set forth in claim 1 wherein, in the piping system, alongside the burner, there is a pressure relief valve incorporating a pressure gauge which indicates the output pressure for its regulation, ensuring optimal pressure at all times for the burner, from which any excess fuel is removed and delivered to the burner feed pipe with a return piping system fitted with a retention valve downstream from the pressure relief valve, in accordance with the characteristics of said burner.

* * * * *